United States Patent [19]

Lamb et al.

[11] 4,398,161

[45] Aug. 9, 1983

[54] PHASE-SHIFTING AMPLIFIER

[75] Inventors: Franklin D. Lamb, Enon; Steve Kiss, Jr.; Thomas K. Krueger, both of Fairborn, all of Ohio

[73] Assignee: The United States of America as represented by the Secretary of the Air Force, Washington, D.C.

[21] Appl. No.: 253,453

[22] Filed: Apr. 13, 1981

[51] Int. Cl.[3] ..... H01P 1/18; H01P 5/04

[52] U.S. Cl. ..... 333/156; 333/164; 343/854

[58] Field of Search ..... 333/156–160, 333/116–117, , 109, 112, 118–119, 161–162, 138–140; 343/854, 858; 330/295, 269, 124 R, 53

[56] References Cited

U.S. PATENT DOCUMENTS

| | | | |
|---|---|---|---|
| 3,323,080 | 5/1967 | Schwelb et al. | 333/157 |
| 3,419,823 | 12/1968 | Seidel | 333/117 |
| 3,516,024 | 6/1970 | Lange | 333/116 |
| 4,161,705 | 7/1979 | Nemit et al. | 333/156 |

*Primary Examiner*—Marvin L. Nussbaum

*Attorney, Agent, or Firm*—Donald J. Singer; Bernard E. Franz

[57] ABSTRACT

A phase shifting circuit comprising a quadrature hybrid for splitting a source of signals into two paths, with an amplifier in each path and a summing hybrid for recombining the outputs from the amplifiers to produce a resultant signal. Phase shift adjustment is achieved by independently varying the gain control voltage of each amplifier.

2 Claims, 2 Drawing Figures

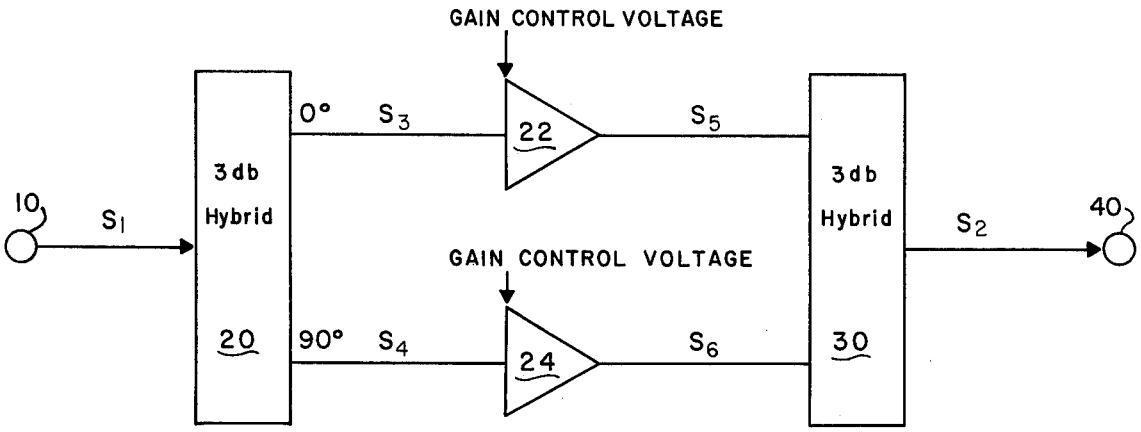
Fig. 1
Fig. 2
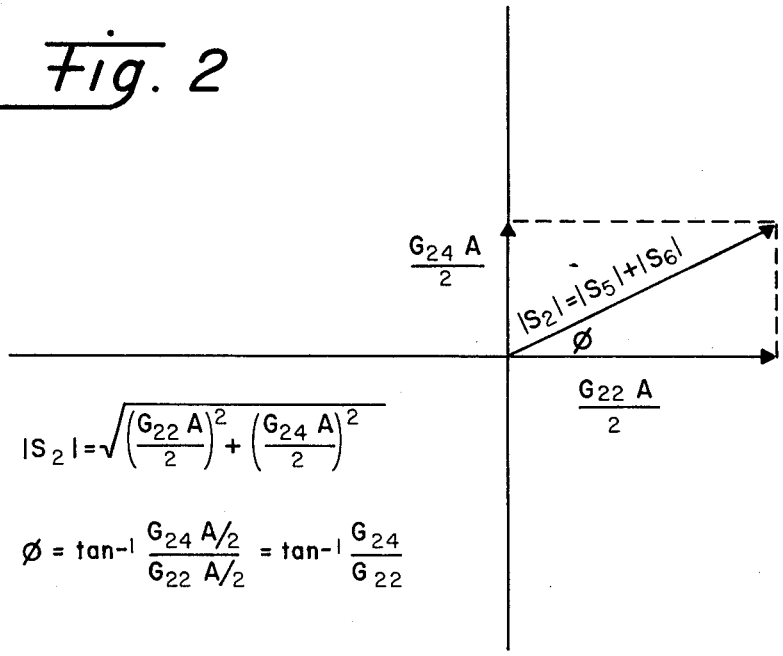
$$|S_2| = \sqrt{\left(\frac{G_{22}A}{2}\right)^2 + \left(\frac{G_{24}A}{2}\right)^2}$$
$$\phi = \tan^{-1}\frac{G_{24}A/2}{G_{22}A/2} = \tan^{-1}\frac{G_{24}}{G_{22}}$$

PHASE-SHIFTING AMPLIFIER

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

This invention relates to active phase shifting circuits and in particular to phase shifters whose shifting characteristics may be accurately controlled.

2. Description of Prior Art

One known type of adjustable phase shifter is described in U.S. Pat. No. 4,087,737. This phase shifter takes the form of an integrator circuit comprising an operational amplifier having a feedback capacitor connected between the amplifier output port and the amplifier inverting input port. A resistor is connected in series between an input terminal and the amplifier inverting input port. Adjustability of the phase shift is achieved by means of a parallel network, connected in shunt with the resistor. The network includes a first capacitor in one branch and a controllable gain amplifier and a second capacitor connected in series in a second branch.

Another phase shifting circuit but of a passive nature involves the use of step attenuators between two hybrids. In such a circuit, a variable loss is employed to generate the applicable phase shift.

SUMMARY OF THE INVENTION

An object of the invention is to provide fine phase control for removing undesirable phase shifts or inserting desired phase shifts with low loss. The invention is capable of achieving phase shift over all frequency ranges limited only by the frequency capabilities of the device in the amplifying stage.

According to the present invention, an input signal is coupled to a hybrid network which splits the signal into separate signal paths differing in quadrature. The separate signal paths are each connected to a balanced amplifier having a variable gain control. The output from each amplifier is recombined in a final summing hybrid to produce a single output whose phase is responsive to the gain independently provided by each of the amplifiers.

An advantage of the circuit of the present invention is its capability of achieving phase shifting in the microwave frequency ranges, i.e. 2–20 GHZ, limited only by the frequency capability of the amplifying devices utilized.

Another advantage of the circuit of the present invention is its ability to provide an ultra or super high frequency response and at the same time provide very fine control over the phase shift adjustment and with extremely low loss.

An additional advantage of this invention is its ability to provide finely tuned variable phase shifting with very few external components and relatively few circuit elements.

One application for this invention would be a low cost technique that will compensate for phase errors in solid state transmit/receive modules making up an active phase array aperture. Both static and dynamic control is possible, thus, errors resulting from manufacturing process and the operating environment can be compensated.

BRIEF DESCRIPTION OF THE DRAWING

FIG. 1 is a functional block diagram showing the invention;

FIG. 2 is a vector diagram showing the operation of the invention.

DETAILED DESCRIPTION

FIG. 1 illustrates an adjustable phase shift circuit according to the preferred embodiment. Input signals from a source 10 are applied to a 3 db hybrid network 20 and split in quadrature. Each of the two resulting signals are separately connected to parallel balanced amplifiers 22 and 24. The amplifiers, preferably Field Effect Transistor (FET) amplifiers, are linear and have adjustable gain controlled by varying the gate or drain voltages by any suitable means such as, for example, a potentiometer. The output of each of the two FET amplifiers is then applied to separate ports of a final hybrid 30 which combines the signals, producing a final resultant source of signals 40. The operation of this invention can best be described by the following analysis in conjunction with FIG. 1.

The input signal ($S_1$) is described as:

$$S_1 = RE[Ae^{j\omega t}]$$

where RE[] means "the real part of", and A is the signal power.

Output signal $S_3$ from hybrid network 20 has the same phase as input signal $S_1$ reduced in power by a factor of 2 or $$S_3 = RE\left[\frac{Ae^{j\omega t}}{2}\right].$$

On the other leg of the hybrid network 20, output signal $S_4$ is shifted in phase by 90° or $$S_4 = RE\left[\frac{Ae^{j\omega t}e^{j90°}}{2}\right].$$

Signals $S_3$ and $S_4$ are amplified, respectively, by FET amplifiers 22 and 24. The output signals of the amplifiers, indicated as $S_5$ and $S_6$ may be described as $$S_5 = RE\left[\frac{G_{22}Ae^{j\omega t}}{2}\right]$$

$$S_6 = RE\left[\frac{G_{24}Ae^{j\omega t}e^{j\omega t}}{2}\right]$$

where $G_{22}$ and $G_{24}$ are the gains of the amplifiers.

For purposes of this analysis, it is assumed that the phase shift through each amplifier is the same. However, it is understood that the desired phase shift could be achieved even though the two amplifiers are not identical by selective variation of gain control voltages to the amplifiers.

Signals $S_5$ and $S_6$ are combined in hybrid 30, producing a resultant output signal $S_2$ which is the sum of signals $S_5$ and $S_6$.

$$S_2 = S_5 + S_6$$

This summation is performed by the parallelogram rule for addition of vectors as shown in FIG. 2, wherein $$S_2 = RE\left[\sqrt{\left(\frac{G_{22}A}{2}\right)^2 + \left(\frac{G_{24}A}{2}\right)^2}\, e^{j(\omega t + \tan^{-1} G_{24}/G_{22})}\right].$$

$$S_2 = RE\left[\frac{A}{2}\sqrt{G_{22}^2 + G_{24}^2}\, e^{j(\omega t + \tan^{-1} G_{24}/G_{22})}\right].$$

From the foregoing it will be apparent that the gains $G_{22}$ and $G_{24}$ can be used to control the phase shift with the amount of the shift given by $\tan^{-1} G_{24}/G_{22}$.

As an example, if $G_{24} = 1$
$G_{22} = 10$
then $\tan^{-1} 1/10 = 5.7°$.

Output signal $S_2$ would then be $$S_2 = RE\left[\frac{A}{2}\sqrt{1^2 + 100}\, e^{j\omega t} e^{j5.7°}\right] \text{ or}$$

$$S_2 = \frac{10A}{2} \operatorname{Cos}(\omega t + 5.7°).$$

Utilizing FET balanced amplifiers, the invention provides phase shift in the frequency range of 2 to 20 GHZ. Multiple numbers of phase shifting amplifiers according to the invention may be used as building blocks, for example, in a phased array antenna system to permit compensation for phase errors inherent in the system. In such an application, a microprocessor, along with digital to analog (D/A) converters, could be utilized to vary the gate or drain voltages of the amplifiers to produce the necessary gain values.

Thus, while preferred constructional features of the invention are embodied in the structure illustrated herein, it is to be understood that changes and variations may be made by the skilled in the art without departing from the spirit and scope of the invention.

What is claimed is:

1. A phased array antenna system, comprising:

a plurality of transmit/receive building block modules of electronic phase shifting circuits compensating for phase errors inherent in said system, said system including at least one microprocessor, and wherein each building block module has a source of input signals coupled to a signal splitting means;

said signal splitting means dividing said input signals into separate signal paths differing in quadrature;

amplifying means connected to said separate signal paths for amplifying the signal in each path;

said amplifying means having a control input for independently varying the gain of said amplifying means, said control means including both static anc dynamic control means;

said microprocessor being coupled via digital to analog converters to said control inputs for independently adjusting the gain of each of said amplifying means; and signal combining means connected to said amplifying means for producing a resultant signal having a phase shift which is proportional to $$\tan^{-1} G_{24}/G_{22}$$

where $G_{24}$ and $G_{22}$ are the gains for the respective amplifying means.

2. The phased array antenna system of claim 1, wherein said amplifying means includes Field Effect Transistor amplifiers.

* * * * *